US008575083B2

(12) United States Patent
Bettiol et al.

(10) Patent No.: US 8,575,083 B2
(45) **Date of Patent: *Nov. 5, 2013**

(54) LIQUID HAND DISWASHING DETERGENT COMPOSITION

(75) Inventors: Jean-Luc Philippe Bettiol, Brussels (BE); Laurence Harcq, Wemmel (BE); Salua Morabet, Brussels (BE); Steven Paul Georges Cooremans, Buggenhout (BE); Bahar Koyuncu, Strombeek-Bever (BE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/698,165

(22) Filed: Feb. 2, 2010

(65) Prior Publication Data

US 2010/0197548 A1 Aug. 5, 2010

(30) Foreign Application Priority Data

Feb. 2, 2009 (EP) ..... 09151882

(51) Int. Cl.
*C11D 17/00* (2006.01)

(52) U.S. Cl.
USPC ..... 510/235; 510/424; 510/473; 510/490; 510/392

(58) Field of Classification Search
USPC ..... 510/235
See application file for complete search history.

(56) References Cited

U.S. PATENT DOCUMENTS

| | | | | |
|---|---|---|---|---|
| 3,915,903 | A | 10/1975 | Wise | |
| 3,981,826 | A | 9/1976 | Munro | |
| 4,169,817 | A | 10/1979 | Weber | |
| 4,326,052 | A | 4/1982 | Kang et al. | |
| 4,326,053 | A | 4/1982 | Kang et al. | |
| 4,377,636 | A | 3/1983 | Kang et al. | |
| 4,385,123 | A | 5/1983 | Kang et al. | |
| 4,760,025 | A | 7/1988 | Estell et al. | |
| 4,820,447 | A | 4/1989 | Medcalf, Jr. et al. | |
| 4,906,396 | A | 3/1990 | Falholt et al. | |
| 5,030,378 | A | 7/1991 | Venegas et al. | |
| 5,336,611 | A | 8/1994 | Van Eekelen et al. | |
| 5,678,630 | A | 10/1997 | Shaw et al. | |
| 5,952,278 | A * | 9/1999 | Mao et al. | 510/235 |
| 6,080,708 | A | 6/2000 | Glenn, Jr. et al. | |
| 6,110,451 | A | 8/2000 | Matz et al. | |
| 6,136,769 | A | 10/2000 | Asano et al. | |
| 6,172,021 | B1 | 1/2001 | Ofosu-Asante et al. | |
| 6,211,829 | B1 | 4/2001 | Saldell et al. | |
| 6,242,405 | B1 | 6/2001 | Lykke et al. | |
| 6,251,849 | B1 | 6/2001 | Jeschke et al. | |
| 6,312,936 | B1 | 11/2001 | Poulose et al. | |
| 6,316,400 | B1 | 11/2001 | Del Duca et al. | |
| 6,323,166 | B1 | 11/2001 | Kamiya | |
| 6,359,031 | B1 | 3/2002 | Lykke et al. | |
| 6,495,136 | B1 | 12/2002 | Weisgerber et al. | |
| 6,521,577 | B1 | 2/2003 | Ofosu-Asante et al. | |
| 6,544,941 | B1 | 4/2003 | Lee et al. | |
| 6,569,261 | B1 | 5/2003 | Aubay et al. | |
| 6,569,663 | B1 | 5/2003 | Rubingh et al. | |
| 6,645,925 | B2 | 11/2003 | Sivik et al. | |
| 6,767,878 | B1 | 7/2004 | Paye et al. | |
| 6,849,584 | B2 | 2/2005 | Geary et al. | |
| 6,906,015 | B1 | 6/2005 | Shiloach | |
| 6,929,939 | B2 | 8/2005 | Estell et al. | |
| 7,115,254 | B1 | 10/2006 | Brandt et al. | |
| 7,119,059 | B2 | 10/2006 | Librizzi et al. | |
| 7,169,745 | B2 | 1/2007 | Kasturi et al. | |
| 7,427,690 | B2 | 9/2008 | Gupta | |
| 2003/0078179 | A1 | 4/2003 | Ghosh et al. | |
| 2004/0234565 | A1 | 11/2004 | Stella et al. | |
| 2005/0049170 | A1 | 3/2005 | Szewczyk | |
| 2005/0069704 | A1 | 3/2005 | Rathschlag et al. | |
| 2005/0148059 | A1 | 7/2005 | Estell et al. | |
| 2006/0111261 | A1 | 5/2006 | Sadlowski et al. | |
| 2007/0082829 | A1 | 4/2007 | Smets et al. | |
| 2007/0213247 | A1 | 9/2007 | Fenyvesi et al. | |
| 2008/0108714 | A1 | 5/2008 | Swazey et al. | |
| 2008/0131393 | A1 | 6/2008 | Yeung et al. | |
| 2008/0234165 | A1 | 9/2008 | Panandiker et al. | |
| 2008/0234169 | A1 * | 9/2008 | Boutique et al. | 510/343 |
| 2008/0242581 | A1 | 10/2008 | Murphy et al. | |
| 2009/0023620 | A1 | 1/2009 | Ochomogo et al. | |
| 2010/0197552 | A1 | 8/2010 | Koyuncu et al. | |
| 2010/0197553 | A1 | 8/2010 | Barnabas et al. | |
| 2010/0197554 | A1 | 8/2010 | Koyuncu et al. | |

FOREIGN PATENT DOCUMENTS

| | | | |
|---|---|---|---|
| EP | 0 013 585 | A1 | 7/1980 |
| EP | 0 520 551 | A2 | 12/1992 |
| EP | 342177 | B1 | 7/1995 |
| EP | 1 013 291 | A1 | 6/2000 |
| EP | 1 072 673 | A2 | 1/2001 |
| EP | 1 288 282 | A1 | 3/2003 |
| EP | 1 319 414 | A1 | 6/2003 |
| EP | 1 288 282 | B1 | 3/2005 |
| GB | 1 197 446 | A | 7/1970 |
| GB | 1 553 202 | A | 9/1979 |
| JP | 07188693 | A | 7/1995 |
| JP | 09003488 | A | 1/1997 |
| JP | 10025494 | A | 1/1998 |

(Continued)

OTHER PUBLICATIONS

PCT International Search Report, Mailed May 3, 2010, 5 Pages.
STN Registry file printout for AROMOX DM12 D-W, coco dimethyl amine oxide, downloaded Jun. 15, 2012.
U.S. Appl. No. 12/698,166, filed Feb. 2, 2010, Bettiol, et al.
U.S. Appl. No. 12/698,167, filed Feb. 2, 2010, Bettiol, et al.
U.S. Appl. No. 12/698,168, filed Feb. 2, 2010, Bettiol, et al.

(Continued)

*Primary Examiner* — Necholus Ogden, Jr.
(74) *Attorney, Agent, or Firm* — John T. Dipre; Steven W. Miller

(57) ABSTRACT

A hand dishwashing detergent composition comprising a specific anionic surfactant system, a pearlescent agent and a rheology modifier, to provide superior grease cleaning combined with hand mildness.

14 Claims, No Drawings

(56) References Cited

FOREIGN PATENT DOCUMENTS

| | | | |
|---|---|---|---|
| JP | 11012596 | A | 1/1999 |
| JP | 2000-129288 | A | 5/2000 |
| JP | 2000 129288 | A2 | 5/2000 |
| JP | 2002348219 | A | 12/2002 |
| JP | 2005-179438 | A2 | 7/2005 |
| WO | WO 89/06270 | A1 | 7/1989 |
| WO | WO 98/15608 | A2 | 4/1998 |
| WO | WO 99/05082 | A1 | 2/1999 |
| WO | WO 99/05084 | A1 | 2/1999 |
| WO | WO 99/05241 | A1 | 2/1999 |
| WO | WO 99/05242 | A1 | 2/1999 |
| WO | WO 99/05243 | A1 | 2/1999 |
| WO | WO 99/05244 | A1 | 2/1999 |
| WO | WO 99/07656 | A1 | 2/1999 |
| WO | WO 99/57201 | A1 | 11/1999 |
| WO | WO 00/23548 | A1 | 4/2000 |
| WO | WO 00/23549 | A1 | 4/2000 |
| WO | WO 00/37627 | A1 | 6/2000 |
| WO | WO 01/81556 | A2 | 11/2001 |
| WO | WO 02/07791 | A2 | 1/2002 |
| WO | WO 02/40627 | A1 | 5/2002 |
| WO | WO 02/092743 | A1 | 11/2002 |
| WO | WO 2005/052146 | A1 | 6/2005 |
| WO | WO 2005/094780 | A1 | 10/2005 |
| WO | WO 2007/028571 | A1 | 3/2007 |
| WO | WO 2007/044993 | B1 | 4/2007 |
| WO | WO 2007/098889 | A1 | 9/2007 |
| WO | WO2007/111898 | * | 10/2007 |
| WO | WO 2007/111898 | A2 | 10/2007 |
| WO | WO 2007/111899 | A2 | 10/2007 |
| WO | WO 2007/135645 | A2 | 11/2007 |
| WO | WO 2007/138053 | A1 | 12/2007 |
| WO | WO 2009/000606 | A1 | 12/2008 |
| WO | WO 2009/010392 | A1 | 1/2009 |

OTHER PUBLICATIONS

U.S. Appl. No. 12/698,169, filed Feb. 2, 2010, Koyuncu, et al.
U.S. Appl. No. 12/698,171, filed Feb. 2, 2010, Koyuncu, et al.
U.S. Appl. No. 12/698,170, filed Feb. 2, 2010, Barnabas, et al.

* cited by examiner

LIQUID HAND DISWASHING DETERGENT COMPOSITION

FIELD OF INVENTION

The present invention relates to a liquid hand dishwashing compositions, and to a method of cleaning dishware with such detergent composition, comprising a specific anionic surfactant system, a pearlescent agent and a rheology modifier, to combine effective grease cleaning with mildness to the skin.

BACKGROUND OF THE INVENTION

Optimisation of grease cleaning is an ongoing task in the field of hand dishwashing. Consumers utilizing liquid detergent as a light-duty liquid dishwashing detergent composition tend to wash greasy, difficult to clean items at the end of their washing experience, after easier to clean items such as glasses and flatware are cleaned. Light-duty liquid dishwashing detergent compositions require a high suds profile while providing grease cleaning.

Recent trend has been to develop hand dishwashing compositions which provide effective cleaning and as well some hand care benefits. For example, Henkel WO2007/028571 discloses liquid aqueous cleaning products for hard surfaces, in particular for manual dishwashing, comprising an active with a beneficial effect on skin sensation that can be selected from sensorial actives and/or actives with a positive biological effect. Lion JP2005-179438 describes a liquid detergent composition for kitchen which reduces hand skin problems caused by detergents, prevents hand skin surface from becoming hard and keeps the hand skin in a fresh condition by using a plant extract, a polyhydric alcohol and a surfactant.

The object of the present invention is to provide compositions which are still very effective in grease cleaning while providing as well excellent hand mildness. It has been found that the specific anionic surfactant system of the present invention will provide the excellent cleaning required from a hand dishwashing liquid composition while being very soft and gentle to the hands. It has been further found that the pearlescent agent of the present invention such as those having a plate like structure e.g. mica, would participate to the skin benefit by their action in skin color correction and on skin gloss correction. The interference with light provided by the pearlescent agent contributes to the correction of colors and of the skin gloss via an adjustment of reflective property of skin. Therefore, it has been found that the combination of the pearlescent agent and the specific anionic surfactant system of the present invention provide superior hand care benefit together with superior grease cleaning.

It is another advantage of the composition of the present invention to communicate to the consumer that such product will indeed provide the claimed hand care benefit. The addition of the pearlescent agent will indeed provide an excellent aesthetics that will communicate to the consumer the benefit of superior skin mildness. The rheology modifier of the present invention will provide a very stable suspension of the pearlescent agent and thereby improved aesthetics to the product.

SUMMARY OF THE INVENTION

The present application relates to a liquid hand dishwashing detergent composition comprising:

(a) 4% to 40% by weight of an anionic surfactant comprising no more than 15% by weight of the total composition, of a sulfonate surfactant;

(b) 0.005% to 3% by weight of an active pearlescent agent; and (c) 0.001% to 3% by weight of a rheology modifier.

The present invention further relates to a method of cleaning dishware with such liquid detergent composition.

DETAILED DESCRIPTION OF THE INVENTION

The liquid hand dishwashing detergent composition and the method of cleaning dishware of the present invention surprisingly provides excellent grease cleaning combined with superior hand skin mildness.

As used herein "grease" means materials comprising at least in part (i.e., at least 0.5 wt % by weight of the grease) saturated and unsaturated fats and oils, preferably oils and fats derived from animal sources such as beef and/or chicken.

As used herein "suds profile" means the amount of sudsing (high or low) and the persistence of sudsing (sustained sudsing) throughout the washing process resulting from the use of the liquid detergent composition of the present composition. As used herein "high sudsing" refers to liquid hand dishwashing detergent compositions which are both high sudsing (i.e. a level of sudsing considered acceptable to the consumer) and have sustained sudsing (i.e. a high level of sudsing maintained throughout the dishwashing operation). This is particularly important with respect to liquid dishwashing detergent compositions as the consumer uses high sudsing as an indicator of the performance of the detergent composition. Moreover, the consumer of a liquid dishwashing detergent composition also uses the sudsing profile as an indicator that the wash solution still contains active detergent ingredients. The consumer usually renews the wash solution when the sudsing subsides. Thus, a low sudsing liquid dishwashing detergent composition formulation will tend to be replaced by the consumer more frequently than is necessary because of the low sudsing level. As used herein, "high sudsing" means a liquid has a sudsing profile before soil addition of at least about 2 cm, preferably at least about 4 cm, and more preferably about 5 cm, as measured using the Sudsing Test Method described herein, and said liquid maintains a suds height of greater than 0.5 cm for at least 2 soil additions, more preferably at least 5 soil additions, even more preferably at least 8 soil additions, as measured using the Sudsing Test Method described herein.

As used herein "dishware" means a surface such as dishes, glasses, pots, pans, baking dishes and flatware made from ceramic, china, metal, glass, plastic (polyethylene, polypropylene, polystyrene, etc.) and wood.

As used herein "liquid hand dishwashing detergent composition" refers to those compositions that are employed in manual (i.e. hand) dishwashing. Such compositions are generally high sudsing or foaming in nature.

As used herein "cleaning" means applying to a surface for the purpose of cleaning, and/or disinfecting.

The Liquid Composition

The liquid detergent compositions herein generally contain from 30% to 95%, preferably 40% to 80%, more preferable 50% to 75% of an aqueous liquid carrier, preferably water, in which the other essential and optional compositions components are dissolved, dispersed or suspended.

The Pearlescent Agent

The pearlescent agents according to the present invention are crystalline or glassy solids, transparent or translucent compounds capable of reflecting and refracting light to produce a pearlescent effect. Typically, the pearlescent agents are crystalline particles insoluble in the composition in which they are incorporated. Preferably the pearlescent agents have the shape of thin plates or spheres. Particle size is measured across the largest diameter of the sphere. Plate-like particles are such that two dimensions of the particle (length and width) are at least 5 times the third dimension (depth or thickness). Other crystal shapes like cubes or needles or other crystal shapes do not display pearlescent effect. Many pearlescent agents like mica are natural minerals having monoclinic crystals. Shape appears to affect the stability of the agents. The spherical, even more preferably, the plate-like agents being the most successfully stabilised. Particle size of the pearlescent agent is typically below 200 microns, preferably below 100 microns, more preferably below 50 microns.

The compositions of the present invention comprise from 0.005% to 3.0% wt, preferably from 0.01% to 1%, by weight of the composition of the 100% active pearlescent agents. The pearlescent agents may be organic or inorganic. The composition can comprise organic and/or inorganic pearlescent agent.

Organic Pearlescent Agents:

When the composition of the present invention comprise an organic pearlescent agent, it is comprised at an active level of from 0.05% to 2.0% wt, preferably from 0.1% to 1.0% by weight of the composition of the 100% active organic pearlescent agents. Suitable organic pearlescent agents include monoester and/or diester of alkylene glycols having the formula:

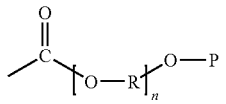

wherein $R_1$ is linear or branched C12-C22 alkyl group;
R is linear or branched C2-C4 alkylene group;
P is selected from H, C1-C4 alkyl or —$COR_2$, $R_2$ is C4-C22 alkyl, preferably C12-C22 alkyl; and
n=1-3.

In one embodiment, the long chain fatty ester has the general structure described above, wherein $R_1$ is linear or branched C16-C22 alkyl group, R is —$CH_2$—$CH_2$—, and P is selected from H, or —$COR_2$, wherein $R_2$ is C4-C22 alkyl, preferably C12-C22 alkyl.

Typical examples are monoesters and/or diesters of ethylene glycol, propylene glycol, diethylene glycol, dipropylene glycol, triethylene glycol or tetraethylene glycol with fatty acids containing from about 6 to about 22, preferably from about 12 to about 18 carbon atoms, such as caproic acid, caprylic acid, 2-ethyhexanoic acid, capric acid, lauric acid, isotridecanoic acid, myristic acid, palmitic acid, palmitoleic acid, stearic acid, isostearic acid, oleic acid, elaidic acid, petroselic acid, linoleic acid, linolenic acid, arachic acid, gadoleic acid, behenic acid, erucic acid, and mixtures thereof.

In one embodiment, ethylene glycol monostearate (EGMS) and/or ethylene glycol distearate (EGDS) and/or polyethylene glycol monostearate (PGMS) and/or polyethyleneglycol distearate (PGDS) are the pearlescent agents used in the composition. There are several commercial sources for these materials. For Example, PEG6000MS® is available from Stepan, Empilan EGDS/A® is available from Albright & Wilson.

In another embodiment, the pearlescent agent comprises a mixture of ethylene glycol diester/ethylene glycol monoester having the weight ratio of about 1:2 to about 2:1. In another embodiment, the pearlescent agent comprising a mixture of EGDS/EGMS having the weight ratio of about 60:40 to about 50:50 is found to be particularly stable in water suspension.

Co-Crystallizing Agents: Optionally, co-crystallizing agents are used to enhance the crystallization of the organic pearlescent agents such that pearlescent particles are produced in the resulting product. Suitable co-crystallizing agents include but are not limited to fatty acids and/or fatty alcohols having a linear or branched, optionally hydroxyl substituted, alkyl group containing from about 12 to about 22, preferably from about 16 to about 22, and more preferably from about 18 to 20 carbon atoms, such as palmitic acid, linoleic acid, stearic acid, oleic acid, ricinoleic acid, behenyl acid, cetearyl alcohol, hydroxystearyl alcohol, behenyl alcohol, linolyl alcohol, linolenyl alcohol, and mixtures thereof. In one embodiment where the co-crystallizing agent is present, the composition comprises 1-5 wt % C12-C20 fatty acid, C12-C20 fatty alcohol, or mixtures thereof. In another embodiment, the weight ratio between the organic pearlescent agent and the co-crystallizing agent ranges from about 3:1 to about 10:1, or from about 5:1 to about 20:1. A preferred method of incorporating organic pearlescent agents into a composition is to use a pre-crystallized organic pearlescent dispersion, named as "cold pearl". A number of cold pearls are commercially available. These include trade names such as Stepan, Pearl-2 and Stepan Pearl 4 (produced by Stepan Company Northfield, Ill.), Mackpearl 202, Mackpearl 15-DS, Mackpearl DR-104, Mackpearl DR-106 (all produced by McIntyre Group, Chicago, Ill.), Euperlan PK900 Benz-W and Euperlan PK 3000 AM (produced by Cognis Corp).

Inorganic Pearlescent Agents:

Preferred for the composition of the present invention are inorganic pearlescent agents. When the composition of the present invention comprise an inorganic pearlescent agent, it is comprised at an active level of from 0.005% to 1.0% wt, preferably from 0.01% to 0.2% by weight of the composition of the 100% active inorganic pearlescent agents.

Inorganic pearlescent agents include aluminosilicates and/or borosilicates. Preferred are the aluminosilicates and/or borosilicates which have been treated to have a very high refractive index, preferably silica, metal oxides, oxychloride coated aluminosilicate and/or borosilicates. More preferred inorganic pearlescent agent is mica, even more preferred titanium dioxide treated mica such as BASF Mearlin Superfine.

It is preferable to use a pearlescent pigment with a high refractive index in order to keep the level of pigment at a reasonably low level in the formulation. Hence the pearlescent agent is preferably chosen such that it has a refractive index of more than 1.41, more preferably more than 1.8, even more preferably more than 2.0. Preferably the difference in refractive index between the pearlescent agent and the composition or medium, to which pearlescent agent is then added, is at least 0.02. Preferably the difference in refractive index between the pearlescent agent and the composition is at least 0.2, more preferably at least 0.6.

One preferred embodiment is metal oxide treated mica such as titanium oxide treated mica with a titanium oxide thickness from 1 nm to 150 nm, preferentially from 2 to 100 more preferentially from 5 to 50 nm to produce a silvery iridescence or from 50 nm to 150 nm produce colors that appear bronze, copper, red, red-violet or red-green. Gold iridescence could be obtained by applying a layer of iron oxide on top of a layer of titanium oxide. Typical interference pigment function of the thickness of the metal oxide layer could be found in scientific literature.

Other commercially available suitable inorganic pearlescent agents are available from Merck under the tradenames Iriodin, Biron, Xirona, Timiron Colorona, Dichrona, Candurin and Ronastar. Other commercially available inorganic pearlescent agent are available from BASF (Engelhard, Mearl) under tradenames Biju, Bi-Lite, Chroma-Lite, Pearl-Glo, Mearlite and from Eckart under the tradenames Prestige Soft Silver and Prestige Silk Silver Star.

The Surfactant System

The composition of the present invention will comprise 4% to 40%, preferably 6% to 32%, more preferably 11% to 25% by weight of the total composition of an anionic surfactant with no more than 15%, preferably no more than 10%, more preferably no more than 5% by weight of the total composition, of a sulfonate surfactant. It has been found that such surfactant system will provide the excellent cleaning required from a hand dishwashing liquid composition while being very soft and gentle to the hands.

Suitable anionic surfactants to be used in the compositions and methods of the present invention are sulfates, sulfosuccinates, sulfoacetates, and/or sulfonates; preferably alkyl sulfate and/or alkyl ethoxy sulfates; more preferably a combination of alkyl sulfates and/or alkyl ethoxy sulfates with a combined ethoxylation degree less than 5, preferably less than 3, more preferably less than 2.

Sulphate Surfactants

Suitable sulphate surfactants for use in the compositions herein include water-soluble salts or acids of $C_{10}$-$C_{14}$ alkyl or hydroxyalkyl, sulphate and/or ether sulfate. Suitable counterions include hydrogen, alkali metal cation or ammonium or substituted ammonium, but preferably sodium.

Where the hydrocarbyl chain is branched, it preferably comprises $C_{1-4}$ alkyl branching units. The average percentage branching of the sulphate surfactant is preferably greater than 30%, more preferably from 35% to 80% and most preferably from 40% to 60% of the total hydrocarbyl chains.

The sulphate surfactants may be selected from $C_8$-$C_{20}$ primary, branched-chain and random alkyl sulphates (AS); $C_{10}$-$C_{18}$ secondary (2,3) alkyl sulphates; $C_{10}$-$C_{18}$ alkyl alkoxy sulphates ($AE_xS$) wherein preferably x is from 1-30; $C_{10}$-$C_{18}$ alkyl alkoxy carboxylates preferably comprising 1-5 ethoxy units; mid-chain branched alkyl sulphates as discussed in U.S. Pat. No. 6,020,303 and U.S. Pat. No. 6,060,443; mid-chain branched alkyl alkoxy sulphates as discussed in U.S. Pat. No. 6,008,181 and U.S. Pat. No. 6,020,303.

Alkyl Sulfosuccinates—Sulfoacetate

Other suitable anionic surfactants are alkyl, preferably dialkyl, sulfosuccinates and/or sulfoacetate. The dialkyl sulfosuccinates may be a $C_{6-15}$ linear or branched dialkyl sulfosuccinate. The alkyl moieties may be symmetrical (i.e., the same alkyl moieties) or asymmetrical (i.e., different alkyl moieties). Preferably, the alkyl moiety is symmetrical.

Sulphonate Surfactants

The compositions of the present invention will preferably comprise no more than 15%, preferably no more than 10%, even more preferably no more than 5% by weight of the total composition, of a sulphonate surfactant. Those include water-soluble salts or acids of $C_{10}$-$C_{14}$ alkyl or hydroxyalkyl, sulphonates; $C_{11}$-$C_{18}$ alkyl benzene sulphonates (LAS), modified alkylbenzene sulphonate (MLAS) as discussed in WO 99/05243, WO 99/05242, WO 99/05244, WO 99/05082, WO 99/05084, WO 99/05241, WO 99/07656, WO 00/23549, and WO 00/23548; methyl ester sulphonate (MES); and alpha-olefin sulphonate (AOS). Those also include the paraffin sulphonates may be monosulphonates and/or disulphonates, obtained by sulphonating paraffins of 10 to 20 carbon atoms. The sulfonate surfactant also include the alkyl glyceryl sulphonate surfactants.

Further Surfactant

The compositions can comprise further a surfactant selected from nonionic, cationic, amphoteric, zwitterionic, semi-polar nonionic surfactants, and mixtures thereof. In a further preferred embodiment, the composition of the present invention will further comprise amphoteric and/or zwitterionic surfactant, more preferably an amine oxide or betaine surfactant.

The total level of surfactants is usually from 1.0% to 50% wt, preferably from 5% to 40% wt, more preferably from 8% to 35% by weight of the liquid detergent composition. Non-limiting examples of optional surfactants are discussed below.

Amphoteric and Zwitterionic Surfactants

The amphoteric and zwitterionic surfactant can be comprised at a level of from 0.01% to 20%, preferably from 0.2% to 15%, more preferably 0.5% to 10% by weight of the liquid detergent composition. Suitable amphoteric and zwitterionic surfactants are amine oxides and betaines. Most preferred amine oxides are coco dimethyl amine oxide or coco amido propyl dimethyl amine oxide. Amine oxide may have a linear or mid-branched alkyl moiety. Typical linear amine oxides include water-soluble amine oxides containing one R1 $C_{8-18}$ alkyl moiety and 2 R2 and R3 moieties selected from the group consisting of $C_{1-3}$ alkyl groups and $C_{1-3}$ hydroxyalkyl groups. Preferably amine oxide is characterized by the formula R1-N(R2)(R3)→O wherein $R_1$ is a $C_{8-18}$ alkyl and $R_2$ and $R_3$ are selected from the group consisting of methyl, ethyl, propyl, isopropyl, 2-hydroxethyl, 2-hydroxypropyl and 3-hydroxypropyl. The linear amine oxide surfactants in particular may include linear $C_{10}$-$C_{18}$ alkyl dimethyl amine oxides and linear $C_8$-$C_{12}$ alkoxy ethyl dihydroxy ethyl amine oxides. Preferred amine oxides include linear $C_{10}$, linear $C_{10}$-$C_{12}$, and linear $C_{12}$-$C_{14}$ alkyl dimethyl amine oxides. As used herein "mid-branched" means that the amine oxide has one alkyl moiety having $n_1$ carbon atoms with one alkyl branch on the alkyl moiety having $n_2$ carbon atoms. The alkyl branch is located on the α carbon from the nitrogen on the alkyl moiety. This type of branching for the amine oxide is also known in the art as an internal amine oxide. The total sum of $n_1$ and $n_2$ is from 10 to 24 carbon atoms, preferably from 12 to 20, and more preferably from 10 to 16. The number of carbon atoms for the one alkyl moiety ($n_1$) should be approximately the same number of carbon atoms as the one alkyl branch ($n_2$) such that the one alkyl moiety and the one alkyl branch are symmetric. As used herein "symmetric" means that $|n_1-n_2|$ is less than or equal to 5, preferably 4, most preferably from 0 to 4 carbon atoms in at least 50 wt %, more preferably at least 75 wt % to 100 wt % of the mid-branched amine oxides for use herein.

The amine oxide further comprises two moieties, independently selected from a $C_{1-3}$ alkyl, a $C_{1-3}$ hydroxyalkyl group, or a polyethylene oxide group containing an average of from about 1 to about 3 ethylene oxide groups. Preferably the two moieties are selected from a $C_{1-3}$ alkyl, more preferably both are selected as a $C_1$ alkyl.

Other suitable surfactants include betaines such alkyl betaines, alkylamidobetaine, amidazoliniumbetaine, sulfobetaine (INCI Sultaines) as well as the Phosphobetaine and preferably meets formula I:

$$R^1—[CO—X(CH_2)_n]_x—N^+(R^2)(R_3)—(CH_2)_m—[CH(OH)—CH_2]_y—Y— \quad \text{(I) wherein}$$

$R^1$ is a saturated or unsaturated C6-22 alkyl residue, preferably C8-18 alkyl residue, in particular a saturated C10-16 alkyl residue, for example a saturated C12-14 alkyl residue;

X is NH, $NR^4$ with C1-4 Alkyl residue $R^4$, O or S, n a number from 1 to 10, preferably 2 to 5, in particular 3, x 0 or 1, preferably 1, $R^2$, $R^3$ are independently a C1-4 alkyl residue, potentially hydroxy substituted such as a hydroxyethyl, preferably a methyl.

m a number from 1 to 4, in particular 1, 2 or 3, y 0 or 1 and

Y is COO, SO3, $OPO(OR^5)O$ or $P(O)(OR^5)O$, whereby $R^5$ is a hydrogen atom H or a C1-4 alkyl residue.

Preferred betaines are the alkyl betaines of the formula (Ia), the alkyl amido betaine of the formula (Ib), the Sulfo betaines of the formula (Ic) and the Amido sulfobetaine of the formula (Id);

$$R^1—N^+(CH_3)_2—CH_2COO^- \quad \text{(Ia)}$$

$$R^1—CO—NH(CH_2)_3—N^+(CH_3)_2—CH_2COO^- \quad \text{(Ib)}$$

$$R^1—N^+(CH_3)_2—CH_2CH(OH)CH_2SO_3— \quad \text{(Ic)}$$

$$R^1—CO—NH—(CH_2)_3—N^+(CH_3)_2—CH_2CH(OH)CH_2SO_3— \quad \text{(Id)}$$

in which $R^1$1 as the same meaning as in formula I. Particularly preferred betaines are the Carbobetaine [wherein $Y^-$=$COO^-$], in particular the Carbobetaine of the formula (Ia) and (Ib), more preferred are the Alkylamidobetaine of the formula (Ib).]

Examples of suitable betaines and sulfobetaine are the following [designated in accordance with INCI]: Almondamidopropyl of betaines, Apricotam idopropyl betaines, Avocadamidopropyl of betaines, Babassuamidopropyl of betaines, Behenam idopropyl betaines, Behenyl of betaines, betaines, Canolam idopropyl betaines, Capryl/Capram idopropyl betaines, Carnitine, Cetyl of betaines, Cocamidoethyl of betaines, Cocam idopropyl betaines, Cocam idopropyl Hydroxysultaine, Coco betaines, Coco Hydroxysultaine, Coco/Oleam idopropyl betaines, Coco Sultaine, Decyl of betaines, Dihydroxyethyl Oleyl Glycinate, Dihydroxyethyl Soy Glycinate, Dihydroxyethyl Stearyl Glycinate, Dihydroxyethyl Tallow Glycinate, Dimethicone Propyl of PG-betaines, Erucam idopropyl Hydroxysultaine, Hydrogenated Tallow of betaines, Isostearam idopropyl betaines, Lauram idopropyl betaines, Lauryl of betaines, Lauryl Hydroxysultaine, Lauryl Sultaine, Milkam idopropyl betaines, Minkamidopropyl of betaines, Myristam idopropyl betaines, Myristyl of betaines, Oleam idopropyl betaines, Oleam idopropyl Hydroxysultaine, Oleyl of betaines, Olivamidopropyl of betaines, Palmam idopropyl betaines, Palm itam idopropyl betaines, Palmitoyl Carnitine, Palm Kernelam idopropyl betaines, Polytetrafluoroethylene Acetoxypropyl of betaines, Ricinoleam idopropyl betaines, Sesam idopropyl betaines, Soyam idopropyl betaines, Stearam idopropyl betaines, Stearyl of betaines, Tallowam idopropyl betaines, Tallowam idopropyl Hydroxysultaine, Tallow of betaines, Tallow Dihydroxyethyl of betaines, Undecylenam idopropyl betaines and Wheat Germam idopropyl betaines. Preferred betaine is for example Cocam idopropyl betaines (Cocoamidopropylbetain).

Nonionic Surfactants

Nonionic surfactant, when present, is comprised in a typical amount of from 0.1% to 20%, preferably 0.5% to 10% by weight of the liquid detergent composition. Suitable nonionic surfactants include the condensation products of aliphatic alcohols with from 1 to 25 moles of ethylene oxide. The alkyl chain of the aliphatic alcohol can either be straight or branched, primary or secondary, and generally contains from 8 to 22 carbon atoms. Particularly preferred are the condensation products of alcohols having an alkyl group containing from 10 to 18 carbon atoms, preferably from 10 to 15 carbon atoms with from 2 to 18 moles, preferably 2 to 15, more preferably 5-12 of ethylene oxide per mole of alcohol.

Also suitable are alkylpolyglycosides having the formula $R^2O(C_nH_{2n}O)_t(\text{glycosyl})_x$ (formula (III)), wherein $R^2$ of formula (III) is selected from the group consisting of alkyl, alkyl-phenyl, hydroxyalkyl, hydroxyalkylphenyl, and mixtures thereof in which the alkyl groups contain from 10 to 18, preferably from 12 to 14, carbon atoms; n of formula (III) is 2 or 3, preferably 2; t of formula (III) is from 0 to 10, preferably 0; and x of formula (III) is from 1.3 to 10, preferably from 1.3 to 3, most preferably from 1.3 to 2.7. The glycosyl is preferably derived from glucose. Also suitable are alkyl glycerol ethers and sorbitan esters.

Also suitable are fatty acid amide surfactants having the formula (IV):

$$R^6C(=O)N(R^7)_2 \quad \text{(IV)}$$

wherein $R^6$ of formula (IV) is an alkyl group containing from 7 to 21, preferably from 9 to 17, carbon atoms and each $R^7$ of formula (IV) is selected from the group consisting of hydrogen, $C_1$-$C_4$ alkyl, $C_1$-$C_4$ hydroxyalkyl, and $—(C_2H_4O)_xH$ where x of formula (IV) varies from 1 to 3. Preferred amides are $C_8$-$C_{20}$ ammonia amides, monoethanolamides, diethanolamides, and isopropanolamides.

Cationic Surfactants

Cationic surfactants, when present in the composition, are present in an effective amount, more preferably from 0.1% to 20%, by weight of the liquid detergent composition. Suitable cationic surfactants are quaternary ammonium surfactants. Suitable quaternary ammonium surfactants are selected from the group consisting of mono $C_6$-$C_{16}$, preferably $C_6$-$C_{10}$ N-alkyl or alkenyl ammonium surfactants, wherein the remaining N positions are substituted by methyl, hydroxyethyl or hydroxypropyl groups. Another preferred cationic surfactant is an $C_6$-$C_{18}$ alkyl or alkenyl ester of a quaternary ammonium alcohol, such as quaternary chlorine esters. More preferably, the cationic surfactants have the formula (V):

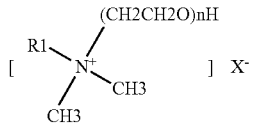

(V)

wherein R1 of formula (V) is $C_8$-$C_{18}$ hydrocarbyl and mixtures thereof, preferably, $C_{8-14}$ alkyl, more preferably, $C_8$, $C_{10}$ or $C_{12}$ alkyl, and X of formula (V) is an anion, preferably, chloride or bromide.

Rheology Modifier

The compositions of the present invention preferably have viscosity from 50 to 2000 centipoises (50-2000 mPa*s), more preferably from 100 to 1500 centipoises (100-1500 mPa*s), and most preferably from 500 to 1300 centipoises (500-1300 mPa*s) at $20^{s-1}$ and 20° C. Viscosity can be determined by conventional methods. Viscosity according to the present invention is measured using an AR 550 rheometer from TA instruments using a plate steel spindle at 40 mm diameter and a gap size of 500 μm. The high shear viscosity at $20^{s-1}$ and low shear viscosity at $0.05^{s-1}$ can be obtained from a logarithmic shear rate sweep from $0.1^{s-1}$ to $25^{s-1}$ in 3 minutes time at 20° C. The preferred rheology described therein may be achieved using internal existing structuring with detergent ingredients or by employing an external rheology modifier.

The composition of the present invention comprises further a rheology modifier.

The overall objective in adding such a rheology modifier to the compositions herein is to arrive at liquid compositions which are suitably functional and aesthetically pleasing from the standpoint of product thickness, product pourability, product optical properties, and/or particles suspension performance. Thus the rheology modifier will generally serve to establish appropriate rheological characteristics of the liquid product and will do so without imparting any undesirable attributes to the product such as unacceptable optical properties or unwanted phase separation.

Generally, the rheology modifier will be comprised at a level of from 0.001% to 3% by weight, preferably from 0.01% to 1% by weight, more preferably from 0.02% to 0.8% by weight of the composition.

One type of structuring agent which is especially useful in the compositions of the present invention comprises non-polymeric (except for conventional alkoxylation), crystalline hydroxy-functional materials which can form thread-like structuring systems throughout the liquid matrix when they are crystallized within the matrix in situ. Such materials can be generally characterized as crystalline, hydroxyl-containing fatty acids, fatty esters or fatty waxes. Such materials will generally be selected from those having the following formulas:

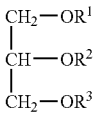

Wherein $R^1$ is the chemical moiety described below and $R^2$ is $R^1$ or H; $R^3$ is $R^1$ or H; $R^4$ is independently $C_{10}$-$C_{22}$ alkyl or alkenyl comprising at least one hydroxyl group;

II)

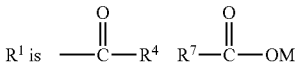

wherein: $R^7$ is the chemical moiety designed below and $R^4$ is as defined above in i); M is $Na^+$, $K^+$, $Mg^{++}$ or $Al^{3+}$, or H; and

III)

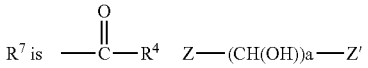

where a is from 2 to 4, preferably 2; Z and Z' are hydrophobic groups, especially selected from $C_6$-$C_{20}$ alkyl or cycloalkyl, $C_6$-$C_{24}$ alkaryl or aralkyl, $C_6$-$C_{20}$ aryl or mixtures thereof. Optionally Z can contain one or more nonpolar oxygen atoms as in ethers or esters.

Materials of the Formula I type are preferred. They can be more particularly defined by the following formula:

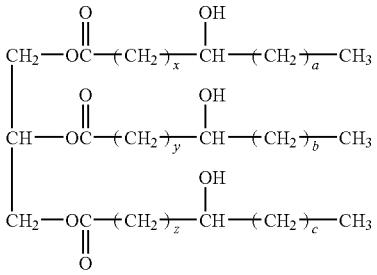

wherein:

(x+a) is from between 11 and 17;

(y+b) is from between 11 and 17; and (z+c) is from between 11 and 17.

Preferably, in this formula x=y=z=10 and/or a=b=c=5.

In a preferred embodiment, the rheology modifier is indeed a crystalline, hydroxyl-containing rheology modifier such as castor oil and its derivatives. Especially preferred are hydrogenated castor oil derivatives such as hydrogenated castor oil and hydrogenated castor wax. Commercially available, castor oil-based, crystalline, hydroxyl-containing rheology modifiers include THIXCIN® from Rheox, Inc. (now Elementis).

Alternative commercially available materials that are suitable for use as crystalline, hydroxyl-containing rheology modifiers are those of Formula III hereinbefore. An example of a rheology modifier of this type is 1,4-di-O-benzyl-D-Threitol in the R,R, and S,S forms and any mixtures, optically active or not. These preferred crystalline, hydroxyl-containing rheology modifiers, and their incorporation into aqueous shear-thinning matrices, are described in greater detail in U.S. Pat. No. 6,080,708 and in PCT Publication No. WO 02/40627.

Other types of rheology modifiers, besides the non-polymeric, crystalline, hydroxyl-containing rheology modifiers described hereinbefore, may be utilized in the liquid detergent compositions herein. Polymeric materials which will provide shear-thinning characteristics to the aqueous liquid matrix may also be employed.

Suitable polymeric rheology modifiers include those of the polyacrylate, polysaccharide or polysaccharide derivative type. Polysaccharide derivatives typically used as rheology modifiers comprise polymeric gum materials. Such gums include pectine, alginate, arabinogalactan (gum Arabic), carrageenan, gellan gum, xanthan gum and guar gum. Gellan gum is commercially marketed by CP Kelco U.S., Inc. under the KELCOGEL tradename. Processes for preparing gellan gum are described in U.S. Pat. Nos. 4,326,052; 4,326,053; 4,377,636 and 4,385,123.

A further alternative and suitable rheology modifier is a combination of a solvent and a polycarboxylate polymer.

More specifically the solvent is preferably an alkylene glycol. More preferably the solvent is dipropy glycol. Preferably the polycarboxylate polymer is a polyacrylate, polymethacrylate or mixtures thereof. The solvent is preferably present at a level of from 0.5 to 15%, preferably from 2 to 9% of the composition. The polycarboxylate polymer is preferably present at a level of from 0.1 to 10%, more preferably 2 to 5% of the composition. The solvent component preferably comprises a mixture of dipropyleneglycol and 1,2-propanediol. The ratio of dipropyleneglycol to 1,2-propanediol is preferably 3:1 to 1:3, more preferably 1:1. The polyacrylate is preferably a copolymer of unsaturated mono- or di-carbonic acid and 1-30C alkyl ester of the (meth) acrylic acid. In an other preferred embodiment the rheology modifier is a polyacrylate of unsaturated mono- or di-carbonic acid and 1-30C alkyl ester of the (meth) acrylic acid. Such copolymers are available from Noveon Inc under the tradename Carbopol Aqua 30.

Another preferred rheology modifier for use in the present invention is Micro Fibril Cellulose (MFC) such as described in US 2008/0108714: microfibrous cellulose, bacterially derived or otherwise, can be used to provide suspension of particulates in surfactant-thickened systems as well as in formulations with high surfactant concentrations. Such MFC is usually present at concentrations from about 0.01% to about 1%, but the concentration will depend on the desired product. For example, while from 0.02 to 0.05% is preferred for suspending small mica platelets in liquid detergent composition. Preferably, MFC is used with co-agents and/or co-processing agents such as CMC, xanthan, and/or guar gum with the microfibrous. US2008/0108714 describes MFC in combination with xanthan gum, and CMC in a ratio of 6:3:1, and MFC, guar gum, and CMC in a ratio of 3:1:1. These blends allow to prepare MFC as a dry product which can be "activated" with high shear or high extensional mixing into water or other water-based solutions. "Activation" occurs when the MFC blends are added to water and the co-agents/co-processing agents are hydrated. After the hydration of the co-agents/co-processing agents, high shear is generally then needed to effectively disperse the MFC to produce a three-dimensional functional network that exhibits a true yield point. Commercially available MFC: Cellulon® from CPKelko.

The Humectant

As used herein "humectant" refers to a hygroscopic substance other than water that imports hydrated water bound to the humectant through hydrogen bonding, into the skin. It is often a molecule with several hydrophilic groups, most often hydroxyl groups, but amines and carboxyl groups, sometimes esterified, can also be encountered.

In a preferred embodiment, the composition of the present invention will further comprise a humectant, typically at a level of from 0.1 wt % to 50 wt %, preferably from 1 wt % to 20 wt %, more preferably from 1 wt % to 10 wt %, even more preferably from 1 wt % to 6 wt %, and most preferably from 2% to 5% by weight of the total composition.

Humectants that can be used according to this invention include those substances that exhibit an affinity for water and help enhance the absorption of water onto a substrate, preferably skin. Specific non-limiting examples of particularly suitable humectants include glycerol, diglycerol, polyethyleneglycol (PEG-4), propylene glycol, hexylene glycol, butylene glycol, (di)-propylene glycol, glyceryl triacetate, polyalkyleneglycols, phospholipids, collagen, elastin, ceramides, lecithin, and mixtures thereof. Others can be polyethylene glycol ether of methyl glucose, pyrrolidone carboxylic acid (PCA) and its salts, pidolic acid and salts such as sodium pidolate, polyols like sorbitol, xylitol and maltitol, or polymeric polyols like polydextrose or natural extracts like quillaia, or lactic acid or urea. Also included are alkyl polyglycosides, polybetaine polysiloxanes, and mixtures thereof. Lithium chloride is an excellent humectant but is toxic. Additional suitable humectants are polymeric humectants of the family of water soluble and/or swellable/and/or with water gelatin polysaccharides such as hyaluronic acid, chitosan and/or a fructose rich polysaccharide which is e.g. available as Fucogel®1000 (CAS-Nr 178463-23-5) by SOLABIA S.

Humectants containing oxygen atoms are preferred over those containing nitrogen or sulphur atoms. More preferred humectants are polyols or are carboxyl containing such as glycerol, diglycerol, Sorbitol, Propylene glycol, Polyethylene Glycol, Butylene glycol; and/or pidolic acid and salts thereof and most preferred are sorbitol, glycerol, sodium lactate and/or urea. Glycerol can be sourced from P&G Chemicals.

Enzymes

In a preferred embodiment of the present invention, the composition will further comprise and enzyme, preferably a protease. It has been found that such composition comprising a protease will provide additional hand mildness benefit.

Suitable proteases include those of animal, vegetable or microbial origin. Microbial origin is preferred. Chemically or genetically modified mutants are included. The protease may be a serine protease, preferably an alkaline microbial protease or a trypsin-like protease. Examples of neutral or alkaline proteases include:

(a) subtilisins (EC 3.4.21.62), especially those derived from *Bacillus*, such as *Bacillus lentus, B. alkalophilus, B. licheniformis, B. subtilis, B. amyloliquefaciens, Bacillus pumilus* and *Bacillus gibsonii*, and *Cellumonas* described in U.S. Pat. No. 6,312,936 B1, U.S. Pat. No. 5,679,630, U.S. Pat. No. 4,760,025, U.S. Pat. No. 5,030,378, WO 05/052146, DEA6022216A1 and DEA 6022224A1.

(b) trypsin-like proteases are trypsin (e.g., of porcine or bovine origin) and the *Fusarium* protease described in WO 89/06270.

(c) metalloproteases, especially those derived from *Bacillus amyloliquefaciens* described in WO 07/044,993A2.

Preferred proteases for use herein include polypeptides demonstrating at least 90%, preferably at least 95%, more preferably at least 98%, even more preferably at least 99% and especially 100% identity with the wild-type enzyme from *Bacillus lentus* or the wild-type enzyme from *Bacillus Amyloliquefaciens*, comprising mutations in one or more of the following positions, using the BPN' numbering system and amino acid abbreviations as illustrated in WO00/37627, which is incorporated herein by reference: 3, 4, 68, 76, 87, 99, 101, 103, 104, 118, 128, 129, 130, 159, 160, 167, 170, 194, 199, 205, 217, 222, 232, 236, 245, 248, 252, 256 & 259.

More preferred proteases are those derived from the BPN' and Carlsberg families, especially the subtilisin BPN' protease derived from *Bacillus amyloliquefaciens*. In one embodiment the protease is that derived from *Bacillus amyloliquefaciens*, comprising the Y217L mutation whose sequence is shown below in standard 1-letter amino acid nomenclature, as described in EP342177B1 (sequence given on p. 4-5).

```
AQSVPYGVSQIKAPALHSQGYTGSNVKVAVIDSGIDSSHPDLKVAGGASM
VPSETNPFQD

NNSHGTHVAGTVAALNNSIGVLGVAPSASLYAVKVLGADGSGQYSWIING
IEWAIANNMD
```

-continued

VINMSLGGPSGSAALKAAVDKAVASGVVVVAAAGNEGTSGSSSTVGYPGK
YPSVIAVGAV

DSSNQRASFSSVGPELDVMAPGVSIQSTLPGNKYGALNGTSMASPHVAGA
AALILSKHPN

WTNTQVRSSLENTTTKLGDSFYYGKGLINVQAAAQ

Preferred commercially available protease enzymes include those sold under the trade names Alcalase®, Savinase®, Primase®, Durazym®, Polarzyme®, Kannase®, Liquanase®, Ovozyme®, Neutrase®, Everlase® and Esperase® by Novozymes A/S (Denmark), those sold under the tradename Maxatase®, Maxacal®, Maxapem®, Properase®, Purafect®, Purafect Prime®, Purafect Ox®, FN3®, FN4®, Excellase® and Purafect OXP® by Genencor International, and those sold under the tradename Opticlean® and Optimase® by Solvay Enzymes. In one aspect, the preferred protease is that sold under the tradename Purafect Prime®, supplied by Genencor International being the subtilisin BPN' protease derived from *Bacillus amyloliquefaciens* with Y217L mutation.

Enzymes may be incorporated into the compositions in accordance with the invention at a level of from 0.00001% to 1%, preferably at a level of from 0.0001% to 0.5%, more preferably at a level of from 0.0001% to 0.1% of enzyme protein by weight of the total composition.

The aforementioned enzymes can be provided in the form of a stabilized liquid or as a protected liquid or encapsulated enzyme. Liquid enzyme preparations may, for instance, be stabilized by adding a polyol such as propylene glycol, a sugar or sugar alcohol, lactic acid or boric acid or a protease stabilizer such as 4-formyl phenyl boronic acid according to established methods. Protected liquid enzymes or encapsulated enzymes may be prepared according to the methods disclosed in U.S. Pat. No. 4,906,396, U.S. Pat. No. 6,221,829 B1, U.S. Pat. No. 6,359,031 B1 and U.S. Pat. No. 6,242,405 B1.

Cationic Polymer

In a preferred embodiment of the present invention, the composition will further comprise a cationic polymer. It has been found that such composition comprising a cationic polymer will provide hand care benefit, more specifically moisturization benefit.

The cationic polymer will typically be present at a level of from 0.001 wt % to 10 wt %, preferably from 0.01 wt % to 5 wt %, more preferably from 0.05% to 1% by weight of the composition.

Suitable cationic deposition polymers for use in current invention contain cationic nitrogen containing moieties such as quaternary ammonium or cationic protonated amino moieties. The average molecular weight of the cationic deposition polymer is between about 5000 to about 10 million, preferably at least about 100000, more preferably at least about 200000, but preferably not more than about 1.5 million. The polymers also have a cationic charge density ranging from about 0.2 meq/g to about 5 meq/g, preferably at least about 0.4 meq/g, more preferably at least about 0.6 meq/g, at the pH of intended use of the dishwashing liquid formulation. As used herein the "charge density" of the cationic polymers is defined as the number of cationic sites per polymer gram atomic weight (molecular weight). Any anionic counterions can be used in association with cationic deposition polymers.

Specific examples of the water soluble cationized polymer include cationic polysaccharides such as cationized cellulose derivatives, cationized starch and cationized guar gum derivatives. Also included are synthetically derived copolymers such as homopolymers of diallyl quaternary ammonium salts, diallyl quaternary ammonium salt/acrylamide copolymers, quaternized polyvinylpyrrolidone derivatives, polyglycol polyamine condensates, vinylimidazolium trichloride/vinylpyrrolidone copolymers, dimethyldiallylammonium chloride copolymers, vinylpyrrolidone/quaternized dimethylaminoethyl methacrylate copolymers, polyvinylpyrrolidone/alkylamino acrylate copolymers, polyvinylpyrrolidone/alkylamino acrylate/vinylcaprolactam copolymers, vinylpyrrolidone/methacrylamidopropyl trimethylammonium chloride copolymers, alkylacrylamide/acrylate/alkylaminoalkylacrylamide/polyethylene glycol methacrylate copolymers, adipic acid/dimethylaminohydroxypropyl ethylenetriamine copolymer, quaternised or protonated condensation polymers having at least 1 heterocyclic group end group connected to the polymer backbone through a unit derived from an alkyl amide, the connection comprising an optionally substituted ethylene group (described in WO2007/098889 by BAS, p 2-19)

Preferred cationic polymers are cationic polysaccharides, more preferably cationic cellulose polymers or cationic guar gum derivatives such as guar hydroxypropyltrimonium chloride, such as the Jaguar series ex Rhodia and N-Hance polymer series available from Aqualon, even more preferred are the salts of hydroxyethyl cellulose reacted with trimethyl ammonium substituted epoxide, referred to in the industry (CTFA) as Polyquaternium-10, such as Ucare LR400 ex Dow Amerchol.

Cleaning Polymer

The composition used in the method of the present invention can further comprise one or more alkoxylated polyethyleneimine polymer. The composition may comprise from 0.01 wt % to 10 wt %, preferably from 0.01 wt % to 2 wt %, more preferably from 0.1 wt % to 1.5 wt %, even more preferable from 0.2% to 1.5% by weight of the composition of an alkoxylated polyethyleneimine polymer as described on page 2, line 33 to page 5, line 5 and exemplified in examples 1 to 4 at pages 5 to 7 of WO2007/135645 published by The Procter & Gamble Company.

The alkoxylated polyethyleneimine polymer of the present composition has a polyethyleneimine backbone having from 400 to 10000 weight average molecular weight, preferably from 400 to 7000 weight average molecular weight, alternatively from 3000 to 7000 weight average molecular weight.

These polyamines can be prepared for example, by polymerizing ethyleneimine in presence of a catalyst such as carbon dioxide, sodium bisulfite, sulfuric acid, hydrogen peroxide, hydrochloric acid, acetic acid, and the like.

The alkoxylation of the polyethyleneimine backbone includes: (1) one or two alkoxylation modifications per nitrogen atom, dependent on whether the modification occurs at a internal nitrogen atom or at an terminal nitrogen atom, in the polyethyleneimine backbone, the alkoxylation modification consisting of the replacement of a hydrogen atom on a polyalkoxylene chain having an average of about 1 to about 40 alkoxy moieties per modification, wherein the terminal alkoxy moiety of the alkoxylation modification is capped with hydrogen, a $C_1$-$C_4$ alkyl or mixtures thereof; (2) a substitution of one $C_1$-$C_4$ alkyl moiety or benzyl moiety and one or two alkoxylation modifications per nitrogen atom, dependent on whether the substitution occurs at a internal nitrogen atom or at an terminal nitrogen atom, in the polyethyleneimine backbone, the alkoxylation modification consisting of the replacement of a hydrogen atom by a polyalkoxylene chain having an average of about 1 to about 40 alkoxy moieties per modification wherein the terminal alkoxy moiety is capped with hydrogen, a $C_1$-$C_4$ alkyl or mixtures thereof; or (3) a combination thereof.

The composition may further comprise the amphiphilic graft polymers based on water soluble polyalkylene oxides (A) as a graft base and sides chains formed by polymerization of a vinyl ester component (B), said polymers having an average of ≤1 graft site per 50 alkylene oxide units and mean molar mass Mw of from 3,000 to 100,000 described in BASF patent application WO2007/138053 on pages 2 line 14 to page 10, line 34 and exemplified on pages 15-18.

Magnesium Ions

The optional presence of magnesium ions may be utilized in the detergent composition when the compositions are used in softened water that contains few divalent ions. When utilized, the magnesium ions preferably are added as a hydroxide, chloride, acetate, sulphate, formate, oxide or nitrate salt to the compositions of the present invention. When included, the magnesium ions are present at an active level of from 0.01% to 1.5%, preferably from 0.015% to 1%, more preferably from 0.025% to 0.5%, by weight of the liquid detergent composition.

Solvent

The present compositions may optionally comprise a solvent. Suitable solvents include $C_{4-14}$ ethers and diethers, glycols, alkoxylated glycols, $C_6$-$C_{16}$ glycol ethers, alkoxylated aromatic alcohols, aromatic alcohols, aliphatic branched alcohols, alkoxylated aliphatic branched alcohols, alkoxylated linear $C_1$-$C_5$ alcohols, linear $C_1$-$C_5$ alcohols, amines, $C_8$-$C_{14}$ alkyl and cycloalkyl hydrocarbons and halohydrocarbons, and mixtures thereof. When present, the liquid detergent composition will contain from 0.01% to 20%, preferably from 0.5% to 20%, more preferably from 1% to 10% by weight of the liquid detergent composition of a solvent. These solvents may be used in conjunction with an aqueous liquid carrier, such as water, or they may be used without any aqueous liquid carrier being present.

Hydrotrope

The liquid detergent compositions of the invention may optionally comprise a hydrotrope in an effective amount so that the liquid detergent compositions are appropriately compatible in water. Suitable hydrotropes for use herein include anionic-type hydrotropes, particularly sodium, potassium, and ammonium xylene sulphonate, sodium, potassium and ammonium toluene sulphonate, sodium potassium and ammonium cumene sulphonate, and mixtures thereof, and related compounds, as disclosed in U.S. Pat. No. 3,915,903. The liquid detergent compositions of the present invention typically comprise from 0% to 15% by weight of the liquid detergent composition of a hydrotropic, or mixtures thereof, preferably from 1% to 10%, most preferably from 3% to 6% by weight.

Polymeric Suds Stabilizer

The compositions of the present invention may optionally contain a polymeric suds stabilizer. These polymeric suds stabilizers provide extended suds volume and suds duration of the liquid detergent compositions. These polymeric suds stabilizers may be selected from homopolymers of (N,N-dialkylamino) alkyl esters and (N,N-dialkylamino) alkyl acrylate esters. The weight average molecular weight of the polymeric suds boosters, determined via conventional gel permeation chromatography, is from 1,000 to 2,000,000, preferably from 5,000 to 1,000,000, more preferably from 10,000 to 750,000, more preferably from 20,000 to 500,000, even more preferably from 35,000 to 200,000. The polymeric suds stabilizer can optionally be present in the form of a salt, either an inorganic or organic salt, for example the citrate, sulphate, or nitrate salt of (N,N-dimethylamino)alkyl acrylate ester.

One preferred polymeric suds stabilizer is (N,N-dimethylamino)alkyl acrylate esters, namely the acrylate ester represented by the formula (VII):

(VII)

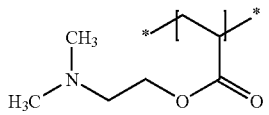

Other preferred suds boosting polymers are copolymers of hydroxypropylacrylate/dimethyl aminoethylmethacrylate (copolymer of HPA/DMAM), represented by the formulae VIII and IX (VIII)

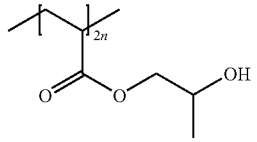

(IX)

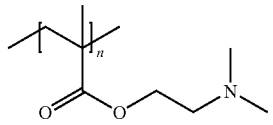

When present in the compositions, the polymeric suds booster/stabilizer may be present in the composition from 0.01% to 15%, preferably from 0.05% to 10%, more preferably from 0.1% to 5%, by weight of the liquid detergent composition.

Another preferred class of polymeric suds booster polymers are hydrophobically modified cellulosic polymers having a number average molecular weight (Mw) below 45,000; preferably between 10,000 and 40,000; more preferably between 13,000 and 25,000. The hydrophobically modified cellulosic polymers include water soluble cellulose ether derivatives, such as nonionic and cationic cellulose derivatives. Preferred cellulose derivatives include methylcellulose, hydroxypropyl methylcellulose, hydroxyethyl methylcellulose, and mixtures thereof.

Diamines

Another optional ingredient of the compositions according to the present invention is a diamine. Since the habits and practices of the users of liquid detergent compositions show considerable variation, the composition will preferably contain 0% to 15%, preferably 0.1% to 15%, preferably 0.2% to 10%, more preferably 0.25% to 6%, more preferably 0.5% to 1.5% by weight of said composition of at least one diamine.

Preferred organic diamines are those in which pK1 and pK2 are in the range of 8.0 to 11.5, preferably in the range of 8.4 to 11, even more preferably from 8.6 to 10.75. Preferred materials include 1,3-bis(methylamine)-cyclohexane (pKa=10 to 10.5), 1,3 propane diamine (pK1=10.5; pK2=8.8), 1,6 hexane diamine (pK1=11; pK2=10), 1,3 pentane diamine (DYTEK EPC)) (pK1=10.5; pK2=8.9), 2-methyl 1,5 pentane diamine (DYTEK AC)) (pK1=11.2; pK2=10.0). Other preferred materials include primary/primary diamines with alkylene spacers ranging from $C_4$ to $C_8$. In general, it is believed that primary diamines are preferred over secondary and tertiary diamines. pKa is used herein in the same manner as is commonly known to people skilled in the art of chemistry: in an all-aqueous solution at 25° C. and for an ionic strength between 0.1 to 0.5 M. Values referenced herein can be obtained from literature, such as from "Critical Stability Constants: Volume 2, Amines" by Smith and Martel, Plenum Press, NY and London, 1975.

Carboxylic Acid

The liquid detergent compositions according to the present invention may comprise a linear or cyclic carboxylic acid or salt thereof to improve the rinse feel of the composition. The presence of anionic surfactants, especially when present in higher amounts in the region of 15-35% by weight of the composition, results in the composition imparting a slippery feel to the hands of the user and the dishware.

Carboxylic acids useful herein include $C_{1-6}$ linear or at least 3 carbon containing cyclic acids. The linear or cyclic carbon-containing chain of the carboxylic acid or salt thereof may be substituted with a substituent group selected from the group consisting of hydroxyl, ester, ether, aliphatic groups having from 1 to 6, more preferably 1 to 4 carbon atoms, and mixtures thereof.

Preferred carboxylic acids are those selected from the group consisting of salicylic acid, maleic acid, acetyl salicylic acid, 3 methyl salicylic acid, 4 hydroxy isophthalic acid, dihydroxyfumaric acid, 1,2,4 benzene tricarboxylic acid, pentanoic acid and salts thereof, citric acid and salts thereof and mixtures thereof. Where the carboxylic acid exists in the salt form, the cation of the salt is preferably selected from alkali metal, alkaline earth metal, monoethanolamine, diethanolamine or triethanolamine and mixtures thereof.

The carboxylic acid or salt thereof, when present, is preferably present at the level of from 0.1% to 5%, more preferably from 0.2% to 1% and most preferably from 0.25% to 0.5%.

The liquid detergent compositions of the present invention may be packages in any suitable packaging for delivering the liquid detergent composition for use. Preferably the package is a clear package made of glass or plastic.

Other Optional Components:

The liquid detergent compositions herein can further comprise a number of other optional ingredients suitable for use in liquid detergent compositions such as perfume, dyes, opacifiers, enzymes, chelants, thickening agents, preservatives, disinfecting agents and pH buffering means so that the liquid detergent compositions herein generally have a pH of from 3 to 14, preferably 6 to 13, most preferably 6 to 10. The pH of the composition can be adjusted using pH modifying ingredients known in the art.

A further discussion of acceptable optional ingredients suitable for use in light-duty liquid detergent composition may be found in U.S. Pat. No. 5,798,505.

The Process of Cleaning/Treating a Dishware

The method of dishwashing of the present invention comprises cleaning a dishware with a light-duty liquid detergent composition comprising the specific anionic surfactant system, the pearlescent agent and the rheology modifier. Said dishwashing operation comprises the steps of applying said composition onto said dishware, typically in diluted or neat form and rinsing said composition from said surface, or leaving said composition to dry on said surface without rinsing said surface. Instead of leaving said composition to dry on said surface on the air, it can also be hand-dried using a kitchen towel. During the dishwashing operation, particularly during the application of said liquid composition to the dishware and/or rinsing away of said liquid composition from the dishware, the hands and skin of the user may be exposed to the liquid composition in diluted or neat form.

By "in its neat form", it is meant herein that said liquid composition is applied directly onto the surface to be treated without undergoing any dilution by the user (immediately) prior to the application. This direct application of that said liquid composition onto the surface to be treated can be achieved through direct squeezing of that said liquid composition out of the hand dishwashing liquid bottle onto the surface to be cleaned, or through squeezing that said liquid composition out of the hand dishwashing liquid bottle on a pre-wetted or non pre-wetted cleaning article, such as without intending to be limiting a sponge, a cloth or a brush, prior to cleaning the targeted surface with said cleaning article. By "diluted form", it is meant herein that said liquid composition is diluted by the user with an appropriate solvent, typically with water. By "rinsing", it is meant herein contacting the dishware cleaned with the process according to the present invention with substantial quantities of appropriate solvent, typically water, after the step of applying the liquid composition herein onto said dishware. By "substantial quantities", it is meant usually 0.1 to 20 liters.

In one embodiment of the present invention, the composition herein can be applied in its diluted form. Soiled dishes are contacted with an effective amount, typically from 0.5 ml to 20 ml (per 25 dishes being treated), preferably from 3 ml to 10 ml, of the liquid detergent composition of the present invention diluted in water. The actual amount of liquid detergent composition used will be based on the judgment of user, and will typically depend upon factors such as the particular product formulation of the composition, including the concentration of active ingredients in the composition, the number of soiled dishes to be cleaned, the degree of soiling on the dishes, and the like. The particular product formulation, in turn, will depend upon a number of factors, such as the intended market (i.e., U.S., Europe, Japan, etc.) for the composition product. Typical light-duty detergent compositions are described in the examples section.

Generally, from 0.01 ml to 150 ml, preferably from 3 ml to 40 ml, even more preferably from 3 ml to 10 ml of a liquid detergent composition of the invention is combined with from 2000 ml to 20000 ml, more typically from 5000 ml to 15000 ml of water in a sink having a volumetric capacity in the range of from 1000 ml to 20000 ml, more typically from 5000 ml to 15000 ml. The soiled dishes are immersed in the sink containing the diluted compositions then obtained, where contacting the soiled surface of the dish with a cloth, sponge, or similar article cleans them. The cloth, sponge, or similar article may be immersed in the detergent composition and water mixture prior to being contacted with the dish surface, and is typically contacted with the dish surface for a period of time ranged from 1 to 10 seconds, although the actual time will vary with each application and user. The contacting of cloth, sponge, or similar article to the dish surface is preferably accompanied by a concurrent scrubbing of the dish surface.

Another method of the present invention will comprise immersing the soiled dishes into a water bath or held under running water without any liquid dishwashing detergent. A device for absorbing liquid dishwashing detergent, such as a sponge, is placed directly into a separate quantity of a concentrated pre-mix of diluted liquid dishwashing detergent, for a period of time typically ranging from 1 to 5 seconds. The absorbing device, and consequently the diluted liquid dishwashing composition, is then contacted individually to the surface of each of the soiled dishes to remove said soiling. The absorbing device is typically contacted with each dish surface for a period of time range from 1 to 10 seconds, although the actual time of application will be dependent upon factors such as the degree of soiling of the dish. The contacting of the absorbing device to the dish surface is preferably accompanied by concurrent scrubbing. Typically, said concentrated pre-mix of diluted liquid dishwashing detergent is formed by combining 1 ml to 200 ml of neat dishwashing detergent with 50 ml to 1500 ml of water, more typically from 200 ml to 1000 ml of water.

Sudsing Test Method.

The sudsing profile can be measured by employing a suds cylinder tester (SCT), having a set of up to 6 cylinders (reference+up to 5 test products). Each cylinder is typically 30 cm long, and 10 cm in diameter. The cylinder walls are 0.5 cm thick, and the cylinder bottom is 1 cm thick. The SCT rotates a test solution in a closed cylinder, typically a plurality of clear plastic cylinders, at a constant rate of about 21 full, vertical revolutions per minute, for 2 minutes, after which the suds height is measured. 1 ml of Eileen B. Lewis Soil (comprising 12.7% Crisco oil, 27.8% Crisco shortening, 7.6% Lard, 51.7% Refined rendered edible beef tallow, 0.14% oleic acid, 0.04% palmitic acid and 0.02% stearic acid. Supplied by J&R Coordinating Services, Ohio) is added to the test solution, agitated again, and the resulting suds height measured, again. More soiling cycles are typically added till a minimum suds height, typically 0.5 cm, is reached. The number of soiling cycles is indicative for the suds mileage performance (more soiling cycles indicates better suds mileage performance). Such a test may be used to simulate the initial sudsing profile of a composition, as well as its sudsing profile during use, as more soils are introduced from the surface being washed.

The sudsing profile test is as follows:

1. Prepare a set of clean, dry, calibrated cylinders, and water having a water hardness of 30 gpg, at temperature 40° C., and at surfactant active concentration of 0.03% by weight.
2. Add the appropriate amount of test composition to each cylinder and add water to make a total 500 mL of composition+water in each cylinder.
3. Seal the cylinders and place them in the SCT.
4. Turn on the SCT and rotate the cylinders for 2 minutes.
5. Within 1 minute, measure the height of the suds in cm. If suds height still higher than 0.5 cm, add immediately after reading the suds height the soil and restart steps 4 and 5.
6. The sudsing profile is the average level of suds, in cm, generated by the composition across 2 replicates.

The "high sudsing liquid" compositions according to the invention preferably have a sudsing profile of at least about 2 cm, more preferably at least about 4 cm, and even more preferably about 5 cm, before soil addition. Soil addition cycles are stopped when suds height in each cylinder reaches 0.5 cm only. For a "high sudsing liquid" the number of soil additions preferably is at least 2, more preferably at least 5, even more preferably at least 8.

Examples

| | Ex. 1 | Ex. 2 | Ex. 3 | Ex. 4 |
|---|---|---|---|---|
| Alkyl C11-14 Ethoxy 0.5-2 Sulfate | 18 | 18 | 15 | 15 |
| Linear Alkylbenzene Sulfonate | 0 | 0 | 3 | 3 |
| Coco dimethyl amine oxide | 6 | 6 | 6 | 6 |
| Sodium Citrate | 2 | 0.2 | 2 | 0.2 |
| Glycol distearate from Euperlan ® Cognis | 0.4 | 0 | 0.4 | 0 |
| Mica (BASF Mearlin superfine) | 0 | 0.05 | 0 | 0.05 |
| Hydrogenated Castor Oil Thixcin ® Elementis | 0 | 0.1 | 0 | 0.1 |
| Microfribil Cellulose from CPKelco | 0.05 | 0 | 0.05 | 0 |
| Glycerol | 3 | 3 | 0 | 0 |
| Purafect Prime ™ Protease (ppm) - Genencor | 25 | 25 | 50 | 50 |
| UCARE LR400 Dow Amerchol Polyquat 10 | 0.1 | 0 | 0.1 | 0 |
| Alcohol: ethanol | 0 | 1 | 0 | 1 |
| Salt: Sodium Chloride | 0.5 | 0.5 | 0.5 | 0.5 |
| Minors* | Balance to 100% with water | | | |

-continued

| | Ex. 5 | Ex. 6 | Ex. 7 | Ex. 8 |
|---|---|---|---|---|
| Alkyl C11-14 Ethoxy 0.5-2 Sulfate | 24 | 24 | 12 | 12 |
| Nonionic[1] | 4 | 4 | 10 | 10 |
| Sodium Citrate | 2 | 0.2 | 2 | 0.2 |
| Glycol distearate from Euperlan ® Cognis | 0.4 | 0 | 0.4 | 0 |
| Mica (BASF Mearlin superfine) | 0 | 0.05 | 0 | 0.05 |
| Hydrogenated Castor Oil Thixcin ® Elementis | 0 | 0.1 | 0 | 0.1 |
| Microfribil Cellulose from CPKelco | 0.05 | 0 | 0.05 | 0 |
| Sorbitol | 3 | 0 | 1 | 0 |
| Purafect Prime ™ Protease (ppm) - Genencor | 25 | 0 | 0 | 0 |
| Alcohol: ethanol | 1 | 0 | 1 | 0 |
| Salt: Sodium Chloride | 0.5 | 0.5 | 0.5 | 0.5 |
| Minors* | Balance to 100% with water | | | |

| | Ex. 9 | Ex. 10 | Ex. 11 | Ex. 12 |
|---|---|---|---|---|
| Alkyl C11-14 Ethoxy 0.5-2 Sulfate | 10 | 10 | 20 | 20 |
| Paraffin Sulfonate | 2 | 2 | 0.5 | 0.5 |
| Coco amido propyl Betaine | 0 | 0 | 5 | 5 |
| Sodium Citrate | 2 | 0.2 | 2 | 0.2 |
| Glycol distearate from Euperlan ® Cognis | 0.4 | 0 | 0.4 | 0 |
| Mica (BASF Mearlin superfine) | 0 | 0.05 | 0 | 0.05 |
| Hydrogenated Castor Oil Thixcin ® Elementis | 0.1 | 0.1 | 0 | 0.1 |
| Microfribil Cellulose from CPKelco | 0 | 0 | 0.05 | 0 |
| Glycerol | 1 | 0 | 1 | 0 |
| Purafect Prime ™ Protease (ppm) - Genencor | 25 | 0 | 0 | 0 |
| Alcohol: ethanol | 0 | 1 | 0 | 1 |
| Salt: Sodium Chloride | 0.5 | 0.5 | 0.5 | 0.5 |
| Minors* | Balance to 100% with water | | | |

[1]Nonionic may be either $C_{11}$ Alkyl ethoxylated surfactant containing 9 ethoxy groups or C10 alkyl ethoxylated surfactant containing 8 ethoxy groups.
*Minors: dyes, opacifier, perfumes, preservatives, hydrotropes, processing aids, stabilizers . . .

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

SEQUENCE LISTING

```
<160> NUMBER OF SEQ ID NOS: 1

<210> SEQ ID NO 1
<211> LENGTH: 275
<212> TYPE: PRT
<213> ORGANISM: Bacillus amyloliquefaciens

<400> SEQUENCE: 1

Ala Gln Ser Val Pro Tyr Gly Val Ser Gln Ile Lys Ala Pro Ala Leu
1               5                   10                  15

His Ser Gln Gly Tyr Thr Gly Ser Asn Val Lys Val Ala Val Ile Asp
            20                  25                  30

Ser Gly Ile Asp Ser Ser His Pro Asp Leu Lys Val Ala Gly Gly Ala
        35                  40                  45

Ser Met Val Pro Ser Glu Thr Asn Pro Phe Gln Asp Asn Asn Ser His
    50                  55                  60

Gly Thr His Val Ala Gly Thr Val Ala Ala Leu Asn Asn Ser Ile Gly
65                  70                  75                  80

Val Leu Gly Val Ala Pro Ser Ala Ser Leu Tyr Ala Val Lys Val Leu
                85                  90                  95

Gly Ala Asp Gly Ser Gly Gln Tyr Ser Trp Ile Ile Asn Gly Ile Glu
            100                 105                 110

Trp Ala Ile Ala Asn Asn Met Asp Val Ile Asn Met Ser Leu Gly Gly
        115                 120                 125

Pro Ser Gly Ser Ala Ala Leu Lys Ala Ala Val Asp Lys Ala Val Ala
    130                 135                 140

Ser Gly Val Val Val Val Ala Ala Ala Gly Asn Glu Gly Thr Ser Gly
145                 150                 155                 160

Ser Ser Ser Thr Val Gly Tyr Pro Gly Lys Tyr Pro Ser Val Ile Ala
                165                 170                 175

Val Gly Ala Val Asp Ser Ser Asn Gln Arg Ala Ser Phe Ser Ser Val
            180                 185                 190

Gly Pro Glu Leu Asp Val Met Ala Pro Gly Val Ser Ile Gln Ser Thr
        195                 200                 205

Leu Pro Gly Asn Lys Tyr Gly Ala Leu Asn Gly Thr Ser Met Ala Ser
    210                 215                 220

Pro His Val Ala Gly Ala Ala Ala Leu Ile Leu Ser Lys His Pro Asn
225                 230                 235                 240

Trp Thr Asn Thr Gln Val Arg Ser Ser Leu Glu Asn Thr Thr Thr Lys
                245                 250                 255

Leu Gly Asp Ser Phe Tyr Tyr Gly Lys Gly Leu Ile Asn Val Gln Ala
            260                 265                 270

Ala Ala Gln
        275
```

What is claimed is:

1. A liquid hand dishwashing detergent composition comprising:

(a) about 4% to about 40% by weight of an anionic surfactant comprising no more than about 15% by weight of the total composition, of a sulfonate surfactant;

(b) about 0.005% to about 3% by weight of an active pearlescent agent;

(c) about 0.001% to about 3% by weight of a rheology modifier; and (d) about 0.01% to about 20% by weight of a surfactant selected from the group consisting of an amphoteric surfactant, a zwitterionic surfactant, and mixtures thereof, wherein the active pearlescent agent is an inorganic pearlescent agent and the liquid hand dishwashing detergent composition is used for hand cleansing of dishware, wherein the rheology modifier comprises micro fibril cellulose, carboxymethyl cellulose (CMC) and a co-agent selected from the group consisting of xanthan gum, guar gum, and mixtures thereof.

2. A composition according to claim 1 wherein the anionic surfactant level is comprised at a level of from about 6% to about 32%.

3. A composition according to claim 1 comprising a combined ethoxylation degree less than 5.

4. A composition according to claim 1 wherein said mixture is selected from the group consisting of amine oxide and betaines surfactants and mixture thereof.

5. The liquid detergent composition according to claim 1 further comprising from about 0.1% to about 20% by weight of a nonionic surfactant selected from the group consisting of $C_8$-$C_{22}$ aliphatic alcohols with 1 to 25 moles of ethylene oxide, alkylpolyglycosides, fatty acid amide surfactants, and mixtures thereof.

6. A composition according to claim 1 wherein said pearlescent agent is a titanium dioxide treated mica.

7. A composition according to claim 1 wherein the active pearlescent agent has a refractive index of more than about 1.41.

8. A composition according to claim 1 wherein said composition further comprises a protease.

9. A composition according to claim 8 wherein said protease is a subtilisin derived from *Bacillus lentus, Bacillus licheniformis, Bacillus alkalophilus, Bacillus subtilis, Bacillus amyloliquefaciens, Bacillus pumilus, Bacillus gibsonii*, and *Bacillus Cellumonas.*

10. A composition according to claim 1 further comprising a cationic polymer.

11. A composition according to claim 10 wherein said cationic polymer is selected from the group consisting of cationic polysaccharides, cationic cellulose polymers, and guar gum derivatives.

12. A composition according to claim 1 further comprising a humectant.

13. A composition according to claim 12 wherein said humectant is selected from the group consisting of polyols or carboxyl humectants.

14. A composition according to claim 13 wherein said humectant is selected from the group consisting of sorbitol, glycerol, sodium, urea and mixtures thereof.

* * * * *